US012565820B2

(12) United States Patent
Koh

(10) Patent No.: US 12,565,820 B2
(45) Date of Patent: Mar. 3, 2026

(54) CHRISTMAS TREE SYSTEM FOR SURFACE HYDROCARBON RECOVERY

(71) Applicant: Baker Hughes Pressure Control LLC, Houston, TX (US)

(72) Inventor: Loy Peng Koh, Singapore (SG)

(73) Assignee: BAKER HUGHES PRESSURE CONTROL LLC, Houston, TX (US)

( * ) Notice: Subject to any disclaimer, the term of this patent is extended or adjusted under 35 U.S.C. 154(b) by 0 days.

(21) Appl. No.: 18/105,470

(22) Filed: Feb. 3, 2023

(65) Prior Publication Data

US 2024/0263540 A1 Aug. 8, 2024

(51) Int. Cl.
*E21B 34/02* (2006.01)
*E21B 43/00* (2006.01)

(52) U.S. Cl.
CPC ..... *E21B 34/025* (2020.05); *E21B 43/00* (2013.01)

(58) Field of Classification Search
CPC ..... E21B 34/02; E21B 34/025; E21B 34/04; E21B 43/00
See application file for complete search history.

(56) References Cited

U.S. PATENT DOCUMENTS 4,848,473 A * 7/1989 Lochte ..... E21B 34/025 166/344
5,010,956 A * 4/1991 Bednar ..... E21B 34/04 166/344
8,672,038 B2 * 3/2014 Tan ..... E21B 41/04 166/344
8,714,261 B2 5/2014 Sbordone
9,970,250 B2 5/2018 Hess
10,808,483 B2 * 10/2020 Hosie ..... E21B 33/035
10,900,315 B2 1/2021 Xiao
10,954,746 B2 * 3/2021 Murphy ..... E21B 47/10
11,162,317 B2 * 11/2021 Zaragoza Labes ..... E21B 34/04
11,542,778 B2 * 1/2023 Bartlett ..... E21B 33/038
2016/0160605 A1 6/2016 Ross
2018/0135375 A1 5/2018 Brown
2020/0355038 A1 11/2020 Donald
2022/0243555 A1 8/2022 Al-Abdulmohsin et al.

FOREIGN PATENT DOCUMENTS

EP 3491215 B1 5/2022
WO 2019/083352 5/2019

OTHER PUBLICATIONS

Baker Hughes, "Aptara TOTEX-lite subsea system," Aug. 11, 2021, https://www.bakerhughes.com/subsea/subsea-connect-solutions/aptara-totexlite-subsea-system, 15 pages.

* cited by examiner

*Primary Examiner* — Matthew R Buck
(74) *Attorney, Agent, or Firm* — Law Office of Darin Duphorne, PLLC

(57) ABSTRACT

Embodiments of the present disclosure include a system for directing the flow of fluids into and out of a wellbore by a production tree. The production tree extends upwardly partially enclosing a section of a production bore. The production bore includes a production master valve, a production wing/swab valve, and a production choke valve. The production master valve, production wing/swab valves, and the production choke valve can be integral with the production bore and the production bore can be substantially parallel with the wellbore.

19 Claims, 7 Drawing Sheets

CHRISTMAS TREE SYSTEM FOR SURFACE HYDROCARBON RECOVERY

BACKGROUND

Field of Invention

The present disclosure relates to hydrocarbon recovery systems. More particularly, the present disclosure relates to hydrocarbon production and fluid injection trees, such as surface production systems, for hydrocarbon recovery, allowing changing configuration throughout the life of the field.

Description of the Prior Art

In oil and gas exploration, sets of valves, spools, and fittings are connected to a wellhead and referred to as a Christmas tree. The components of the Christmas tree direct and control the flow of fluids into and out of underground formations containing hydrocarbons. A variety of government regulations stipulate the number of barriers arranged between the wellbore and other components. This can result in complicated and often expensive Christmas tree arrangements on wells.

These complex Christmas trees can result in large footprints around the wellbore. This can take up additional space at the well site, resulting in additional surface area requirements for the Christmas tree and longer piping and instrumentation runs between the Christmas tree and other equipment. Additionally, large and complex Christmas trees may be difficult to access for maintenance of the wellsite and Christmas tree itself. Complex Christmas trees can also include numerous flanges and fittings for connections to different processes. This can result in additional potential failure and leak points within the Christmas tree, which can result in safety and environmental hazards should a leak occur. It is now recognized that simplified production and injection systems that are also regulatory compliant are desired.

SUMMARY

Applicant recognized the problems noted above herein and conceived and developed embodiments of systems and methods, according to the present disclosure, for surface hydrocarbon recovery systems.

One embodiment of the present technology provides for a system for recovering hydrocarbons from a wellbore by a production tree. The production tree can include a production bore fluidly coupled to the production tubing in the wellbore and extending through the body of the production tree. The production tree can further include a production master valve in the production bore which can be moveable between open and closed positions to regulate fluid flow. The production master valve can be positioned downstream of the wellbore. The production tree can include a production wing/swab valve arranged in the production bore positioned downstream of the production master valve. The production wing/swab valve can move between open and closed positions to regulate fluid flow. The production tree can include a production choke valve positioned downstream of the production wing/swab valve. The production choke valve can also move between open and closed positions to regulate fluid flow through the production bore.

In alternate embodiments, the production tree can include a wireline intervention access port located between the production wing/swab valve and the production choke. There can be a second production master valve between the production master valve and the production wing/swab valve. In some embodiments, there can be no separate wing valve downstream of the production tree.

In alternate embodiments, the system can include a pump cap coupled to the top of the production tree to enhance recovery of the downhole fluids. In other embodiments the system can include a high-pressure pipeline protection system (HIPPS) positioned downstream of the production master valve and production wing/swab valve. The HIPPS can protect the production tree and downstream equipment from high pressure in the wellbore.

The production bore, production master valve, production wing/swab valve, and the production choke valve can be integrated within the production tree in some embodiments. The outlet of the production choke valve can be substantially parallel with the wellbore. A portion of the production tree above the production master valve can be replaceable with a production tree cap.

A second embodiment of the present technology provides for a system for directing fluids into and out of an underground formation. The system can include a wellhead apparatus supporting a tubing hanger and enclosing at least a portion of a production bore. The system can also include a production tree downstream of the wellhead apparatus including a production master valve and a production wing/swab valve.

The system can also include a downhole pump cap coupled to the top of the production tree. The tree cap can also be a high-pressure pipeline production system (HIPPS).

The system can alternatively include a production choke valve downstream of the production wing/swab valve to regulate fluid flow through the production bore. The production master valve, production wing/swab valve, and production choke can be integral to the production tree. The production choke can also be substantially parallel to the wellbore.

A third embodiment of the present technology provides for a hydrocarbon recovery system comprising a production tree with a production bore, production master valve, production wing/swab valve, and a production master valve. The valves can be moveable to regulate fluid flow through a production bore. The movement can be controlled with actuators extending radially outward from the production tree. The actuators can extend radially outward from the tree in different radial directions.

The system can further include a pump cap coupled to the top of the production tree. The pump cap can perform enhanced recovery operations. Alternatively, a high-pressure pipeline production system can be provided downstream of the production master valve and production wing/swab valve.

There can also be a production choke valve downstream of the production wing/swab valve. The production choke valve can regulate fluid flow in the production bore. The outlet of the production choke can be substantially parallel with the wellbore.

BRIEF DESCRIPTION OF THE DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1:
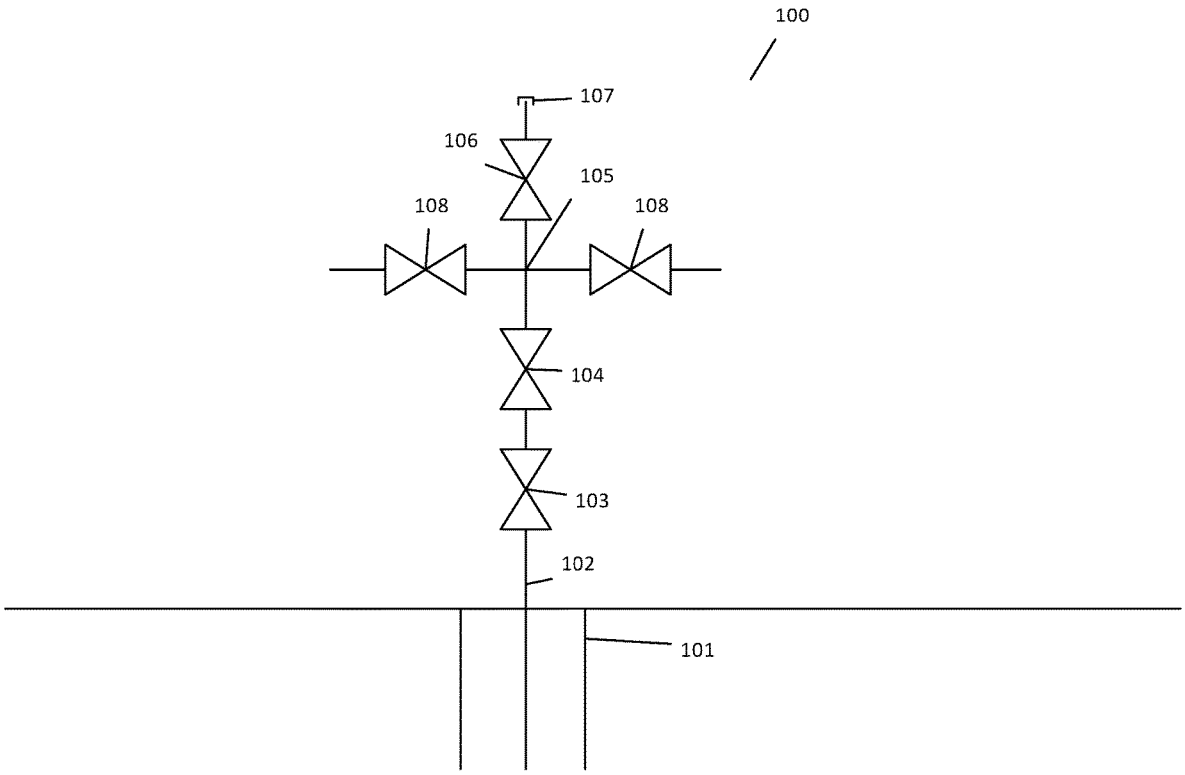
FIG. 1 (PRIOR ART)
FIG. 1 is a schematic diagram of a prior art embodiment of a Christmas tree (XT).

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include a simplified Christmas tree (XT) (e.g., production tree) arrangement for use in oil and gas recovery. The simplified XT can also be used for injection of fluids into well sites. This can comprise injections of water, air, steam, carbon dioxide or hydrogen. Injections can be made for well treatment operations, geothermal operations, or carbon capture and storage operations.

The simplified XT can eliminate several fittings and valves which may traditionally be found on the XT, thereby reducing costs and complexity at the well site. This can be done through the use of multi-purpose valves and fittings as opposed to valves and fittings that are used for only a single purpose. This can be done by integrating the swab or crown valve with one of the two block valves in some embodiments. The reduced number of fittings and valves can also reduce the number of potential leak points on the XT. The valves of the XT can be manual or actuated valves. This can enable associated control modules to control valves and equipment associated with auxiliary components, which can further simplify well site operations by reducing the total number of controllers used for recovery operations.

Furthermore, in certain embodiments, the simplified XT can be shorter, thinner, and lighter than a traditional XT. The simplified XT can have a loose stacked or composite block configuration. As a result, the XT may be easier to haul to the well site allowing for accelerated delivery times, easier to install at the well site without specialized equipment, and may be more compact and with a smaller footprint to enable associated components to be installed proximate the XT. The use of 90 degree or 45 degree angled valves can help contribute to the smaller footprint. The simplified XT can maintain at least two barriers between the wellbore and the environment, thereby satisfying government regulations and industry standards for oil and gas recovery operations. Accordingly, the embodiments disclosed herein enable fabrication of XTs with reduced costs, greater simplicity, and use in a greater number of well site operations.

FIG. 1 is a schematic diagram of a prior art embodiment of a traditional XT 100. The XT 100 can sit on top of a wellbore and wellhead 101. Production tubing 102 can run from the wellbore 101 and into the traditional XT 100. After exiting the wellbore 101 the production tubing 102 can pass through a lower master valve 103 and upper master valve 104. These master valves 103 and 104 can provide the dual redundant isolation valves often required by regulations to isolate the wellbore 101 from the equipment on the surface. The two master valves 103 and 104 can also contribute to the height and bulk of the XT 100. The master valves 103 and 104 can often be spaced out with a long spool piece between the master valves 103 and 104 due to actuators for the master valves 103 and 104 located on the same side of the XT 100.

Downstream of the lower and upper master valves 103 and 104 a tee 105 can give access to the production tubing 102 from several different directions. Directly above the tee 105 there can be a swab valve 106. This valve can be used to provide access to the production tubing 102 with different well intervention equipment. To do so a cap and plug 107 can be removed from above the swab valve 106 while the swab valve 106 is closed and the production tubing 102 above the swab valve 106 is isolated from pressure in the wellbore 101 to provide access for intervention equipment. Subsequently, the swab valve 106, upper master valve 104, and lower master valve 103 can be opened to give the intervention equipment access to the production tubing 102 and wellbore 101. The inclusion of a separate swab valve 106 can further increase the height and complexity of the XT 100 in combination with the tee 105.

On either side of the tee 105 there can be wing valves 108. One wing valve 108 can be a kill wing valve. A kill wing valve can provide access for fluid injection into the production tubing 102 and wellbore 101. This can include corrosion preventers, methanol, dehydration formulas, or any other appropriate injection fluid. The other wing valve 108 can be a production wing valve. Hydrocarbons from the wellbore 101 can exit the production wing valve to downstream storage facilities, processing facilities, or any other appropriate facility for receiving hydrocarbons. Production choke located downstream of the PMV is used to control the flowrate out of the production tubing 102. The outlets to the wing valves 108 can be at a 90-degree angle to the wellbore 101 resulting in the XT 100 taking up increasing horizontal space around the well. This can also require special shipping requirements of the XT 100 to the well site due to the width of the XT 100 with the wing valves 108.

Additional valves, gauges, transmitters, and connections can be further added to the XT 100. This can result such that the XT 100 has a large footprint above the wellbore 101 taking up space that could be used for other pieces of equipment. Additionally, access to and operation of the valves can be difficult due to the size and complexity of the XT 100. Actuated valves and additional electronic pressure and temperature transmitters can add to the size and inaccessibility of the XT 100.

Figure 2A:
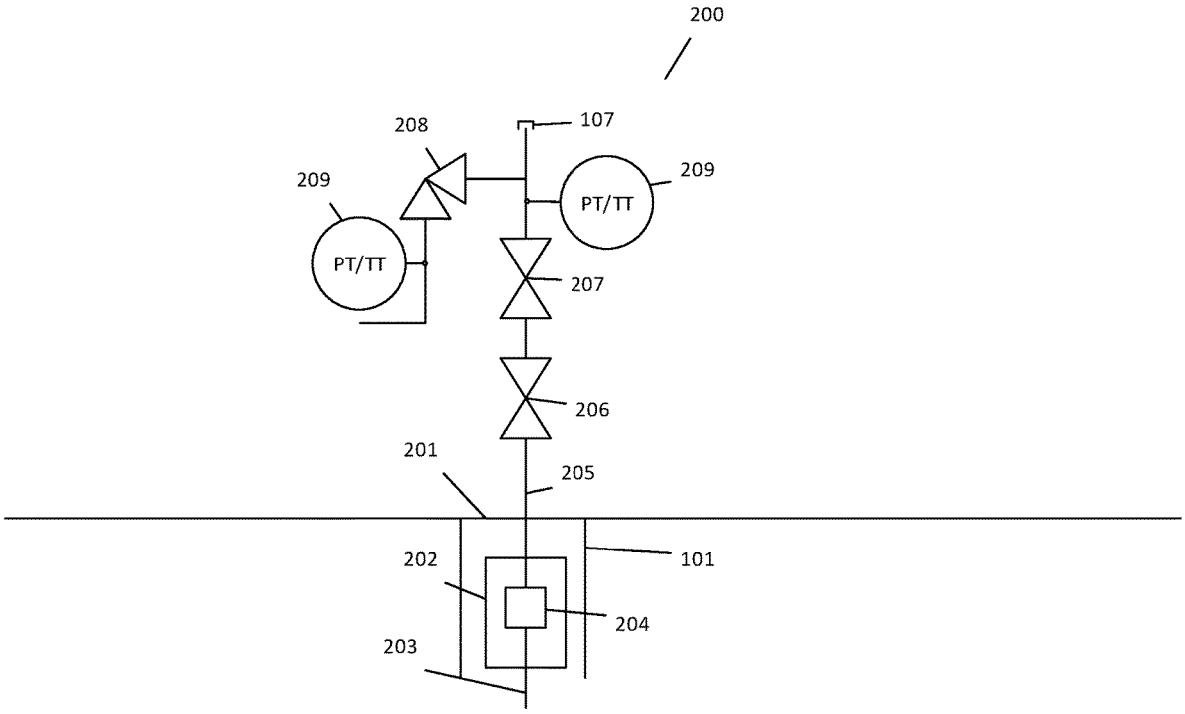
FIG. 2A is a schematic diagram of an embodiment of a simplified XT coupled to a tubing head spool, in accordance with embodiments of the present disclosure.

FIG. 2A is a schematic diagram of an embodiment of a simplified XT 200 positioned on a tubing head spool 201. In certain embodiments, components that are positioned at or near the wellbore 101 may be referred to as a wellhead assembly. The tubing head spool 201 can be suspended over the wellbore 101 and can be coupled to the wellhead housing. A tubing hanger 202 can land and lock into the tubing head spool 201. Production tubing 203 can extend from the tubing hanger 202 into the wellbore 101 for recovery of hydrocarbons. In certain embodiments, hydrocarbons may refer to downhole fluids, which may include a liquid, a gas, a solid, or a combination thereof. An isolation plug 204 can be arranged within the tubing hanger 202. During installation or replacement of the XT 200, the isolation plug 204 can block pressure from the production tubing 203 from exerting a force on the XT 200. It should be understood that tubing may refer to tubular piping arrangements, often constructed from metal, that have pressure and temperature ratings sufficient for wellbore operations. Furthermore, as used herein, bore refers to a flow path or conduit to transport fluids (e.g., gas, liquid, solid, or a combination thereof). In certain embodiments, the production bore 205 may be formed by tubing. Moreover, in certain embodiments, the production bore 205 may be formed within a body or a housing that forms the XT 200. Additionally, in certain embodiments, the production bore 205 may be formed by a combination of a body, tubing, and any other reasonable component that may be utilized to transport a fluid. In other embodiments, the production bore 205 may be formed from individual components which can be stacked and bolted to form the XT. In certain embodiments, the production bore 205 (at least the portion located within the XT 200) can be sized according to the requirements of the production tubing 203.

In the embodiment illustrated in FIG. 2A, the production bore 205 can transfer recovered hydrocarbons, under pressure, from the production tubing 203 to the XT 200. As illustrated, at least a portion of the production bore 205 can be positioned within the tubing head spool 201, which may be referred to as a lower section. Moreover, at least a portion of the production bore 205 can be included within the XT 200, which may be referred to as an upper section. The XT 200 of FIG. 2A may be referred to as a vertical XT because of its substantially vertical arrangement.

Referring to the production bore 205, moving downstream from the wellbore 101 in a direction relative to the direction of fluid flow out of the wellbore 101, the production bore 205 can include a pair of master valves 206 and 207. The master valves can transition between an open and closed position (and intermediate positions in certain embodiments) to regulate flow through the bores. The master valve 206 may be referred to as a production master valve (PMV) while the master valve 207 may be referred to as a production wing/swab valve (PWSV). These two master valves 206 and 207 can provide at least two barriers between the wellbore 101 and downstream equipment, as can be required per governmental regulations. As used herein, the barrier refers to a valve or other device capable of blocking flow along a flow line. For example, a valve would be a barrier because it may transition to a closed position to block flow.

The PMV 206 can be the primary form of isolation of the wellbore 101. The PWSV 207 can perform several functions on the XT 200. The PWSV 207 in combination with the PMV 206 can provide for the dual isolation requirements as previously referenced. The PWSV 207 can further act as the swab valve 106 as it can be used for well intervention through the cap and plug 107. Here, the PWSV 207 can be used to isolate the downstream production bore 205 so that the production bore 205 above the PWSV 207 can be depressurized prior to insertion of the well intervention tools. Additionally, the PWSV 207 can act as the wing valve 108 of the traditional XT 100 to isolate downstream equipment from well pressure when required.

Downstream of the PWSV there can be production choke valve (PCV) 208. The PCV 208 can control the flow of hydrocarbons in the production bore 205 to downstream processes. The PCV 208 can be designed at a 90-degree angle such that hydrocarbons can enter the PCV 208 through the side and can leave the PCV 208 from the bottom such that the outlet of the PCV 208 can be parallel with the wellbore 101. This can keep the production bore 205 leaving the PCV 208 in proximity with the production bore 205 coming up from the wellbore 101 and passing through the PMV 206 and PWSV 207. This can reduce the overall footprint of the XT 200 by keeping the PCV 208 and associated production bore 205 in proximity with the rest of the XT 200.

The illustrated XT 200 can also include a variety of pressure and/or temperature transducers 209. This instrumentation may be arranged between valves, such as the transducer 209 positioned between the PWSV 207 and the PCV 208. The transducers 209 can be used to monitor for leaks between closed valves. For example, by closing the PCV 208, leaks in the production bore 205 leaving the XT 200 may be evaluated via the one or more transducers 209 arranged on the line.

Figure 2B:
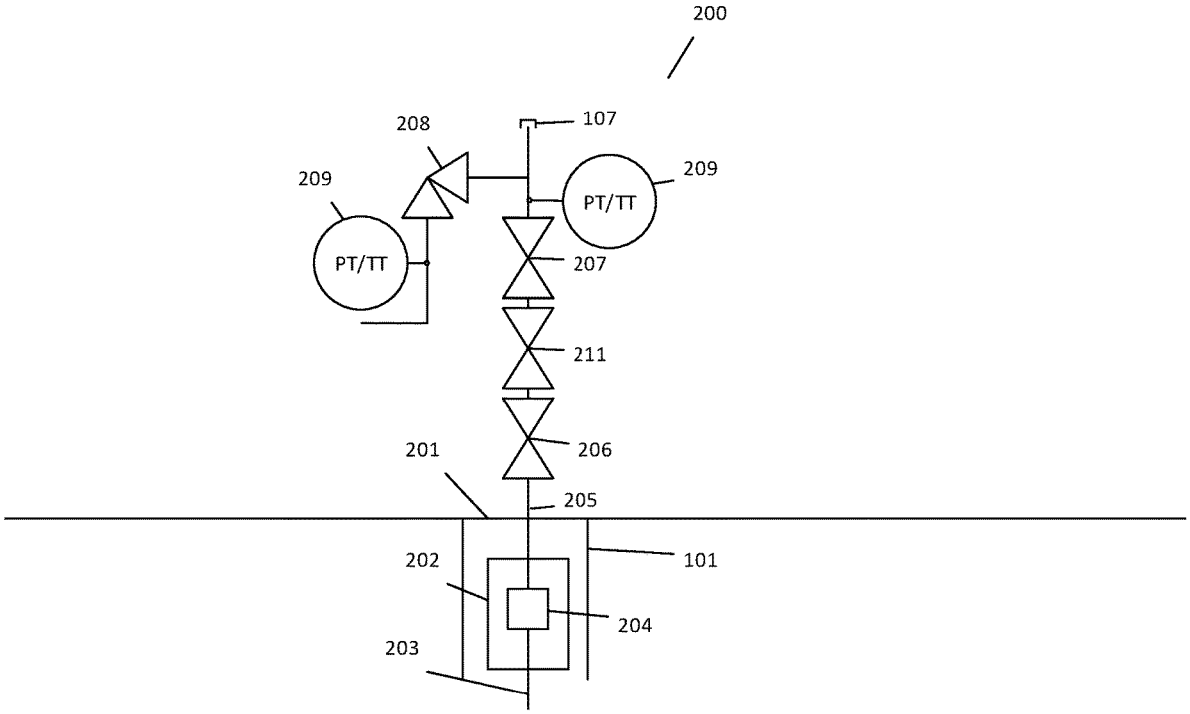
FIG. 2B is a schematic diagram of an alternative embodiment of a simplified XT coupled to a tubing head spool, in accordance with embodiments of the present disclosure.

FIG. 2B is a second embodiment of a simplified XT 200. This embodiment can include a second production master valve (SPMV) 211 which can be located between the PMV 206 and the PWSV 207. This can be included to provide a third layer of protection when it is required to isolate the wellbore 101 from downstream processes. The addition of the SPMV 211 can negligibly alter the footprint of the XT 200 such that the XT 200 may not require additional space with the addition of the SPMV 211.

In both FIGS. 2A and 2B it should be appreciated that the PMV 206, PWSV 207, PCV 208 and SPMV 210 can be of an integral block configuration or split configuration to the XT 200 such that they can be moved as a single component. This can simplify the XT 200 making it easier to transport and install than individual components and valves. Without an external 90 degree orientated wing valve, the XT 200 can be both a smaller system for shipping and a more compact system for installation in the field and access to components of the XT 200.

Figure 3:
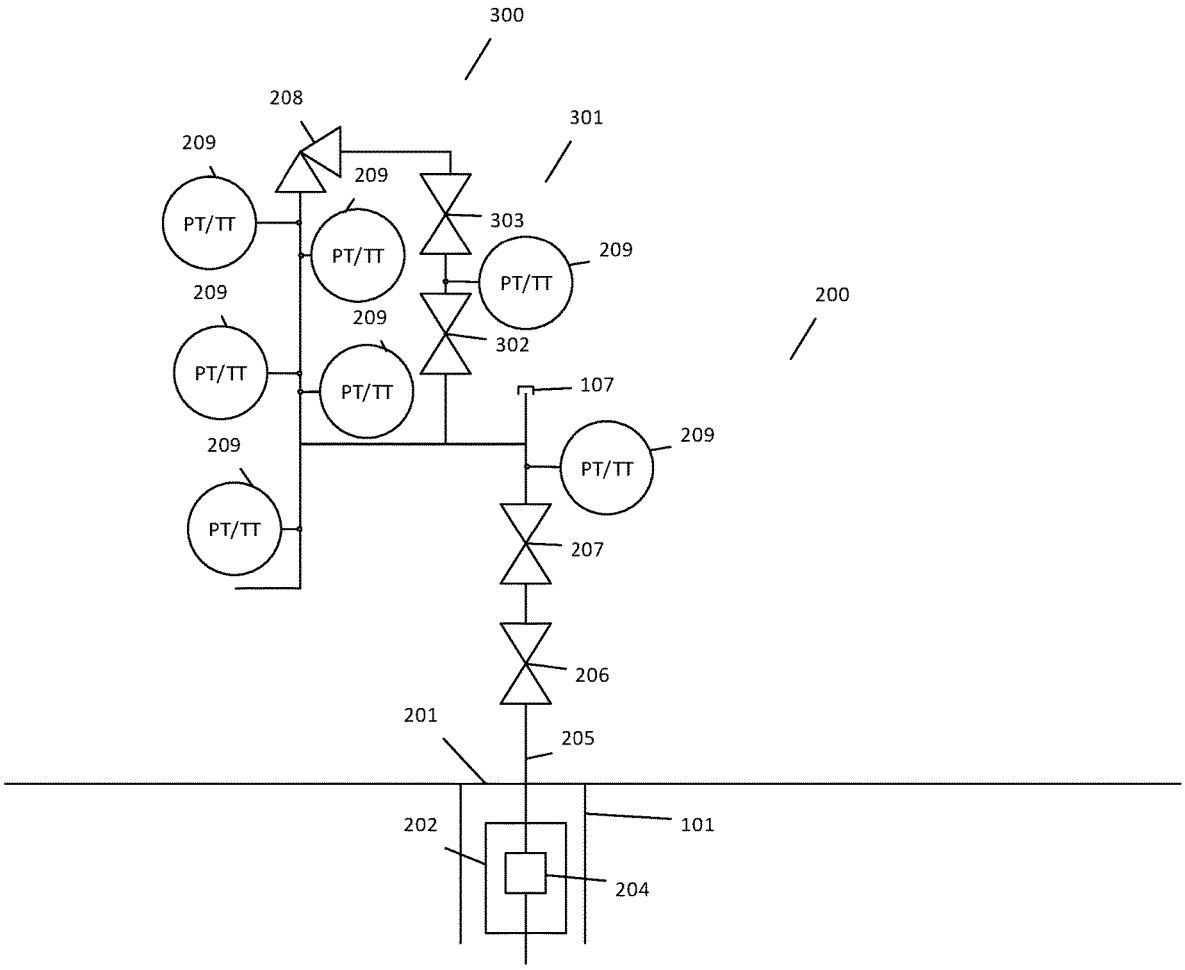
FIG. 3 is a schematic diagram of an embodiment of a simplified XT with high integrity pipeline protection system (HIPPS), in accordance with embodiments of the present disclosure.
Figure 4:
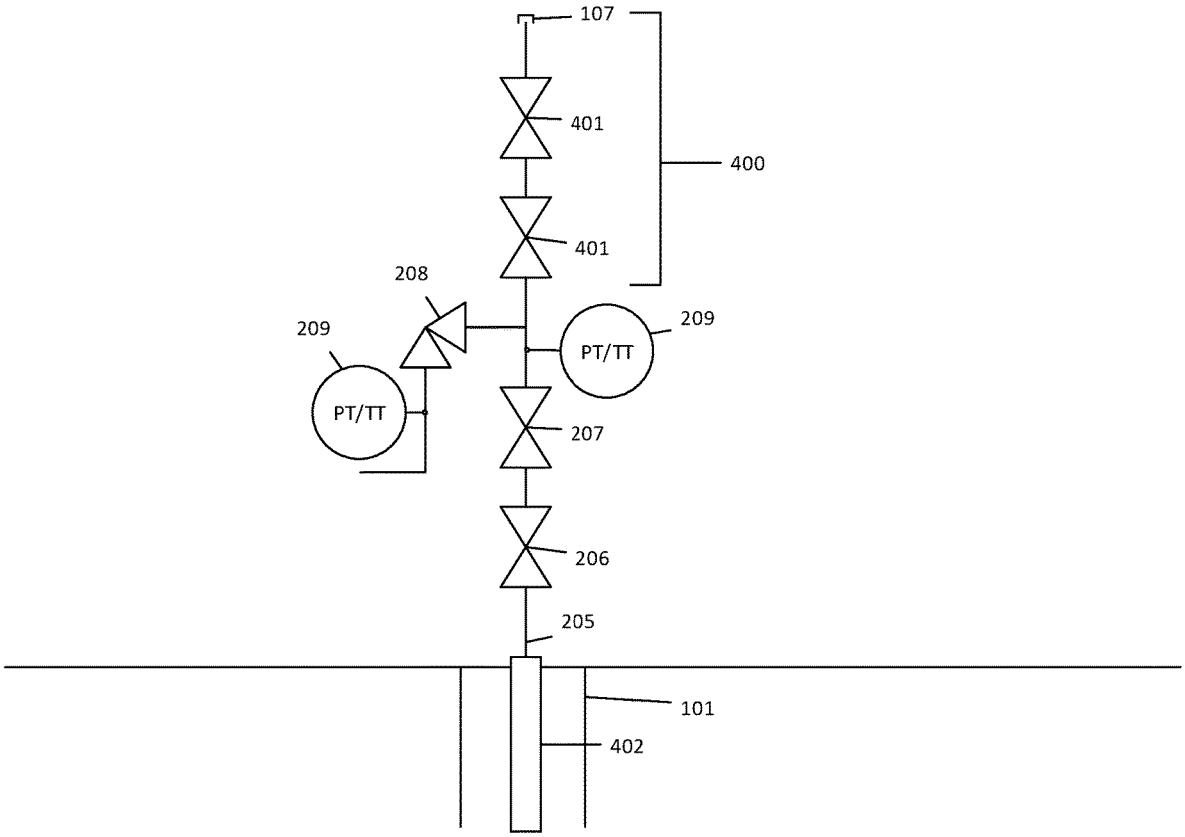
FIG. 4 is a schematic diagram of an embodiment of a pump cap coupled to an XT, in accordance with embodiments of the present disclosure.

Alternatively, the XT 200 can include a separate connection above the PMV 206. This can allow the portion of the XT 200 located above the PMV 206 to be removed and replaced as required. This can include the replacement with different tree caps as depicted in FIGS. 3 and 4. These tree caps can include a high-pressure pipeline protection system, a pump cap, or any other appropriate cap to suit the life of the field.

FIG. 3 is a schematic diagram of an embodiment of the simplified XT 200 in which the tree cap 300 includes a high-pressure pipeline protection system 301 (HIPPS). Certain embodiments of the XT 200 illustrated in FIG. 3 can be shared with the XT 200 of FIGS. 2A and 2B. It should be appreciated that the HIPPS 301 can be installed between either the XT 200 and the manifold or downstream of the manifold to allow the production bore 205 or other flow line downstream of the HIPPS 301 to be delivered with a lower pressure rating. In certain embodiments, the HIPPS 301 can be a stand-alone module that can be coupled to XT 200 or at another location.

In the illustrated embodiment, the HIPPS 301 can include a pair of valves 302 and 303, the tree cap 300, and PCV 208. Moreover, the HIPPS 301 can include additional pressure and/or temperature transducers 209 to monitor activity in the wellbore 101. It should be appreciated that the HIPPS 301 can be designed to be removed from the XT 200 when operations using the HIPPS 301 are complete, such as when pressure in the reservoir is decreased and enhanced recovery techniques are used to recover additional hydrocarbons.

FIG. 4 is a schematic diagram of an embodiment of the simplified XT 200 with a pump cap 400. In embodiments, the pump cap 400 may be referred to as an electric pump (ESP) 402 cap. As shown, the pump cap 400 can be arranged to couple to the XT 200 at the top in place of the tree cap. The pump cap 400 illustrated in FIG. 4 can include a pair of isolation plugs or valves 401. These plugs or valves 401 can be utilized to block in portions of the XT 200 to isolate the pressure containing portions from the pump cap 400. As shown, the pump cap 400 can be positioned downstream of the PMV 206 and the PWSV 207, relative to a direction of flow out of the wellbore 101.

In operation, the pump cap 400 may be equipped to lower an electric pump 402 through the XT 200, specifically through the production bore 205 by a cable hanger on a spool in the illustrated embodiment. Alternatively, the pump cap 400 can include a surface based electric pump. For instance, at the end of life an oil well may undergo secondary recovery operations, such as pumping or gas lift, to extract hydrocarbons after formation pressures have been depleted. The arrangement illustrated in FIG. 4 can enable the pump cap 400 to fully integrate into the XT 200 to lower the ESP 402 into the wellbore 101 through the production bore 205. As a result, continued recovery from the well may commence without removing significant components, often resulting in delay and high costs. It should be appreciated that certain features have been eliminated for clarity. For example, in embodiments, the pump cap 400 may be covered and additional equipment, for example associated with the ESP 402, may also be installed proximate the wellbore 101.

Figure 5:
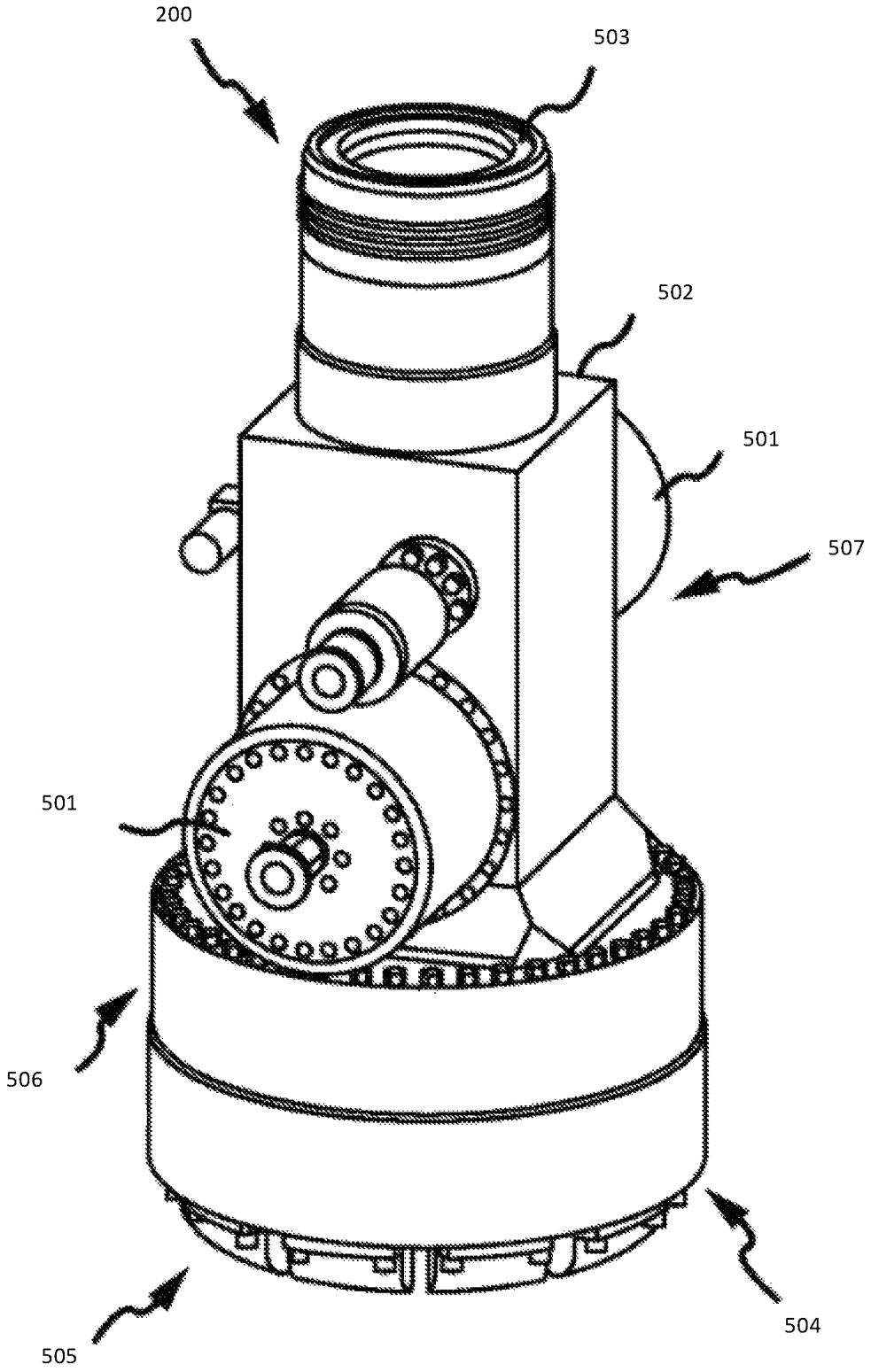
FIG. 5 is an isometric view of an embodiment of an XT, in accordance with embodiments of the present disclosure.

FIG. 5 is an isometric view of an embodiment of the XT 200. The illustrated XT 200 can include actuators 501 positioned on the body 502 of the XT 200. In certain embodiments, the actuators 501 can be low-profile actuators, thereby reducing a width of the XT 200. As a result, the XT 200 may be transported to well sites, for example via highways, without escorts or special permitting due to the width. In other words, the XT 200 may be approximately as wide as a flatbed truck. Furthermore, the XT 200 illustrated in FIG. 5 does not include the cap, however, it should be appreciated that the cap may be threaded/bolted or otherwise connected to a top 503 (e.g., upper surface) of the XT 200.

As shown in FIG. 5, the XT 200 can include a base 504 (e.g., lower surface) and extends upwardly toward the top 503. The body 502 can form at least a portion of the XT 200 and provides one or more mounting locations for various equipment and instrumentation, such as fittings 505 for coupling various lines, instrumentation, and the like to the XT 200 and the actuators 501.

It should be appreciated that any reasonable number of fittings may be included and that the number of fittings and their respective positions are for illustrative purposes only and that certain features may be omitted for clarity. In certain embodiments, the fittings may include the junctions illustrated in the diagrams above to couple the valve components to the XT 200. The XT 200 includes a circumference or perimeter 505. As illustrated, the actuators 501 can be arranged at different circumferential positions 506 and extend outwardly a radial distance from the body 502.

Figure 6:
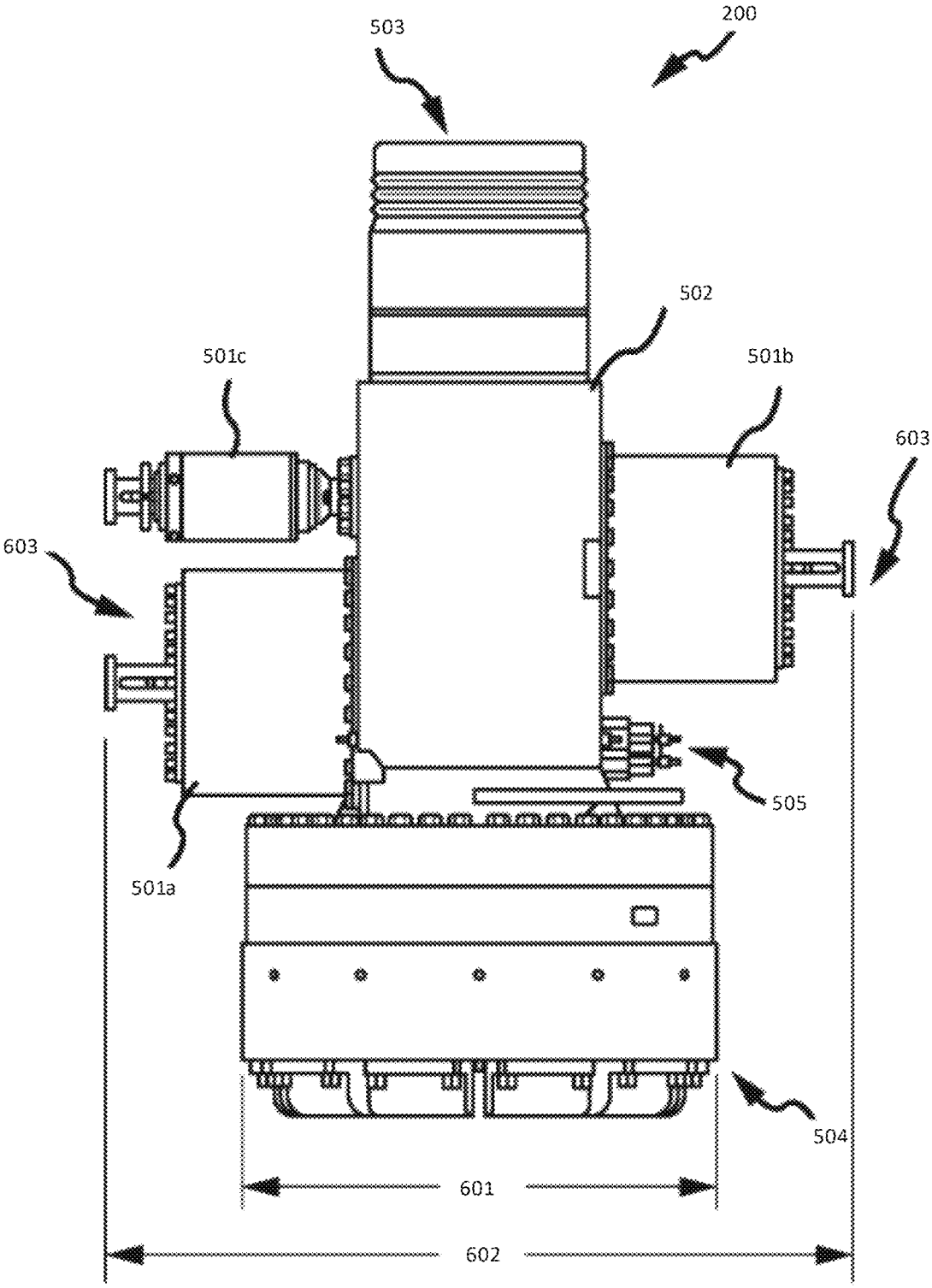
FIG. 6 is a side elevational view of an embodiment of an XT, in accordance with embodiments of the present disclosure.

FIG. 6 is a side elevational view of the XT 200. In the illustrated embodiments, the actuators 501 for the master valve 206 in the production bore 205 can be arranged on opposite sides of the body 502, thereby reducing the height or elevation of the XT 200. The actuators 501 can be the same or different sizes depending on the requirements of the XT 200. For instance, the actuator 501*a* can be arranged to control the PMV 206 and the actuator 501*b* can be arranged to control the PWSV 205. By positioning the actuators 501*a* and 501*b* on opposite sides of the XT 200, portions of the actuator bodies may overlap, as illustrated in FIG. 6. If the actuators 501*a* and 501*b* were stacked, these actuator bodies may not be able to overlap, thereby increasing the overall height or elevation of the XT 200. Advantageously, the actuators 501 can also enable the actuator 501*c* that controls the PCV 208 from extending the height of the XT 200 because portions of the actuator 501*c* body can align with portions of the actuator 501*b* body. In other words, the configuration of the actuators 501 on the body 502 can be particularly selected to decrease the height of the XT 200. Additionally, the configuration of the actuators 501 can decrease the footprint of the XT 200.

In the illustrated embodiment, the actuators 501 extend outwardly from the body 502 and can be radially wider than the width 601, as illustrated by the width 602. Yet, the inclusion of low-profile actuators, as illustrated in FIG. 6, along with the varying circumferential positions 603, can enable a smaller footprint for the XT 200 than by utilizing traditional actuators.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A system for recovering hydrocarbons from a wellbore, comprising:

a production tree coupled to a wellbore component, the production tree comprising:

a production bore fluidly coupled to production tubing of the wellbore component, the production bore extending through a body of the production tree and topped with a production cap;

a production master valve in the production bore, the production master valve being moveable between an open position and a closed position to regulate a flow of fluids through the production bore, the production master valve positioned downstream relative to the wellbore component;

a production wing/swab valve in the production bore, the production wing/swab valve movable between an open position and a closed position to regulate the flow of fluids parallel to the production bore, the production wing/swab valve positioned downstream of the production master valve and in series with the production master valve and capable of providing access for intervention equipment when the production wing/swab valve is in the closed position;

a production choke valve parallel to the production bore, the production choke valve moveable between an open position and a closed position to regulate the flow of fluids through the production bore, the production choke positioned downstream of the production wing/swab valve and below the production cap.

2. The system of claim 1, further comprising a second production master valve between the production master valve and the production wing/swab valve.

3. The system of claim 1, where there is not an integral wing valve downstream of the production choke valve.

4. The system of claim 1, further comprising a surface or downhole pump cap separate from the production cap, the pump cap coupled to a top of the production tree to perform enhanced recovery operations.

5. The system of claim 1, further comprising a high-pressure pipeline protection system (HIPPS), the HIPPS positioned downstream of the production master valve and the production wing/swab valve.

6. The system of claim 1, wherein the production bore, the production master valve, the production wing/swab valve, and the production choke valve are integrated into the production tree.

7. The system of claim 1, wherein an outlet of the production choke valve is substantially parallel with the wellbore.

8. The system of claim 1, wherein a portion of the production tree above the production master valve is replaceable with the production tree cap.

9. A system for recovering hydrocarbons from a wellbore, the system comprising:

a wellhead apparatus supporting a tubing hanger, the wellhead apparatus at least partially enclosing at least a portion of a production bore, the production bore topped with a production cap; and a production tree positioned downstream of and coupled to the wellhead apparatus, the production tree at least partially enclosing at least a portion of the production bore, wherein the production bore includes a production master valve positioned downstream of the wellhead apparatus, a production choke valve parallel to the production bore and below the production cap, and a production wing/swab valve positioned upstream of the production choke valve and capable of providing access for intervention equipment when the production wing/swab valve is in a closed position.

10. The system of claim 9, further comprising a surface or downhole pump cap separate from the production cap, the pump cap coupled to a top of the production tree to perform enhanced recovery operations.

11. The system of claim 9, wherein the production choke valve is positioned downstream of the production wing/swab valve to regulate the flow of fluids through the production bore.

12. The system of claim 11, wherein the production bore, the production master valve, the production wing/swab valve, and the production choke valve are integral to the production tree.

13. The system of claim 11, wherein an outlet of the production choke valve is substantially parallel with the wellbore.

14. The system of claim 9, wherein the production cap includes a high-pressure pipeline protection system (HIPPS) to protect the system from high fluid pressures.

15. A system for recovering hydrocarbons from a wellbore, the system comprising:

a production tree coupled to the wellbore, the production tree including a production bore topped with a production cap;

a first production master valve in the production bore, the first production master valve movable between an open position and a closed position to regulate a flow of a fluid through the production bore;

a production wing/swab valve in the production bore, the production wing/swab valve being moveable between an open position and a closed position to regulate the flow of fluid through the production bore, and capable of providing access for intervention equipment when the production wing/swab valve is in the closed position;

a production choke valve parallel to the production bore and positioned below the production cap;

a production master valve actuator coupled to the production master valve, the production master valve actuator extending radially outward from the production tree at a first circumferential location;

a production wing/swab valve actuator coupled to the production wing/swab valve, the production wing/swab valve actuator extending radially outward from the production tree at a second circumferential location, the second circumferential location being offset from the first circumferential location such that the production master valve actuator and the production wing/swab valve actuator extend radially outward in different radial directions.

16. The system of claim 15, further comprising a surface or downhole pump cap separate from the production cap, the pump cap coupled to a top of the production tree to perform enhanced recovery operations.

17. The system of claim 15, further comprising a high-pressure pipeline protection system (HIPPS), the HIPPS being positioned downstream of the production master valve and the production wing/swab valve.

18. The system of claim 15, wherein the production choke valve is positioned downstream of the production wing/swab valve to regulate the flow of fluids through the production bore.

19. The system of claim 18, wherein an outlet of the production choke valve is substantially parallel with the wellbore.

* * * * *